US009370927B2

(12) United States Patent
Ohnishi et al.

(10) Patent No.: US 9,370,927 B2
(45) Date of Patent: Jun. 21, 2016

(54) INKJET PRINTING DEVICE AND PRINTING METHOD

(71) Applicant: MIMAKI ENGINEERING CO., LTD., Nagano (JP)

(72) Inventors: Masaru Ohnishi, Nagano (JP); Kosuke Murai, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/647,451

(22) PCT Filed: Nov. 29, 2013

(86) PCT No.: PCT/JP2013/082150

§ 371 (c)(1),
(2) Date: May 27, 2015

(87) PCT Pub. No.: WO2014/084336

PCT Pub. Date: Jun. 5, 2014

(65) Prior Publication Data

US 2015/0306871 A1 Oct. 29, 2015

(30) Foreign Application Priority Data

Nov. 30, 2012 (JP) ..... 2012-263809

(51) Int. Cl.

| | |
|---|---|
| ***B41J 29/38*** | (2006.01) |
| ***B41J 29/393*** | (2006.01) |
| ***B41J 2/145*** | (2006.01) |
| ***B41J 2/045*** | (2006.01) |
| ***B41J 2/21*** | (2006.01) |

(52) U.S. Cl.

CPC ..... *B41J 2/04568* (2013.01); *B41J 2/04586* (2013.01); *B41J 2/2139* (2013.01)

(58) Field of Classification Search

CPC .. B41J 2/04543; B41J 2/04586; B41J 29/393; B41J 2/2139; B41J 2/04568

USPC ..... 347/9, 12, 19, 40

See application file for complete search history.

(56) References Cited

FOREIGN PATENT DOCUMENTS

| | | |
|---|---|---|
| JP | 2008-155399 | 7/2008 |
| JP | 2011-079331 | 4/2011 |

OTHER PUBLICATIONS

"International Search Report (Form PCT/ISA/210)", mailed on Jan. 14, 2014, with English translation thereof, pp. 1-2.

*Primary Examiner* — Jannelle M Lebron

(74) *Attorney, Agent, or Firm* — Jianq Chyun IP Office

(57) ABSTRACT

The invention has an object to provide an advantageous technology that minimizes banding that may appear on an image printed using a print head having a nozzle row (22) to obtain printed images with a better image quality. A print operation includes discharging ink on a printing medium through an active nozzle row (23) and at least one nozzle (21) not continuous from at least one end of the active nozzle row (23). The active nozzle row (23) is re-selected so that an amount of shift of the active nozzle row (23) from one end of the nozzle row (22) is changed every time when the active nozzle row (23) discharges ink a predetermined number of times.

10 Claims, 10 Drawing Sheets

INKJET PRINTING DEVICE AND PRINTING METHOD

CROSS-REFERENCE TO RELATED APPLICATION

This application is a 371 application of an international PCT application serial no. PCT/JP2013/082150, filed on Nov. 29, 2013, which claims the priority benefit of Japan application no. JP 2012-263809, filed on Nov. 30, 2012. The entirety of each of the above-mentioned patent applications is hereby incorporated by reference herein and made a part of this specification.

TECHNICAL FIELD

The invention relates to an inkjet printing device and a printing method, more particularly to an inkjet printing device that carries out a print operation using a print head having a nozzle row with a plurality of aligned nozzles, and a printing method.

BACKGROUND ART

A known problem with the serial inkjet printing devices is banding (streaks) that may appear due to overlap of bands formed in one scan. To solve the problem, there is developed a technique for selecting a part of the nozzle row as an active nozzle row in charge of discharging ink to scan a printing medium, and changing the position of the active nozzle row (Patent Document 1).

PRIOR ART DOCUMENT

Patent Document

Patent Document 1: JP 2008-155399 A (disclosed on Jul. 10, 2008).

SUMMARY OF THE INVENTION

Problems to be Solved by the Invention

A more advantageous printing technique than the technique described in the patent document 1 is highly anticipated to obtain printed images improved in quality. According to the technique described in the Patent Document 1, vertical lines may be particularly noticeable, which is a problem to be addressed and solved.

The invention was accomplished to solve the problem. The invention has an object to provide an advantageous technology that minimizes banding that may appear during a printing operation by using a print head having a nozzle row to obtain printed images with a better image quality.

Solutions to the Problems

To achieve the object, the invention provides an inkjet printing device, including: a print head having a nozzle row with a plurality of aligned nozzles; a nozzle selector for selecting plural ones of the nozzles continuously aligned in a part of the nozzle row as an active nozzle row; a main scan controller for driving the print head to perform a scan in a main scan direction intersecting the nozzle row; and a sub scan controller for moving a printing medium relative to the print head in a sub scan direction in parallel with a direction in which the nozzle row is extending, wherein the print head is driven by the main scan controller to perform the scan in the main scan direction; and discharging ink on the printing medium through the active nozzle row and at least one of the nozzles not continuous from at least one end of the active nozzle row for performing a print operation, and the nozzle selector re-selects the active nozzle row so that an amount of shift of the active nozzle row from one end of the nozzle row is changed every time when the active nozzle row discharges ink a predetermined number of times.

According to the above configuration, when a print operation is carried out, the nozzle selector changes the amount of shift (position) of the active nozzle row in charge of discharging ink, so that a boundary between the bands can be shifted forward and backward in the sub scan direction. This can reduce the appearance of banding.

In the case of discharging ink from the active nozzle row alone, which has plural ones of the nozzles continuously aligned in a part of the nozzle row, vertical lines may stand out in an obtained printed image. In contrast, the inkjet printing device according to the above configuration is configured to discharge ink through, in addition to the active nozzle row, the nozzle(s) not continuous from at least one end of the active nozzle row. On a vertical line of a printed image, between parts of the image printed with ink discharged through the continuously aligned nozzles (active nozzle row), there is accordingly an intermediate region printed with ink discharged through the non-continuous nozzle. This makes the vertical lines least noticeable, providing a printed image with a higher quality.

The inkjet printing device is preferably further characterized in that the nozzle selector selects the active nozzle row so that the number of nozzles in the active nozzle row is Z and a difference between minimum and maximum values of the amount of shift +1 equals Nmax, wherein the Nmax and the Z are parameters that are arbitrarily changeable.

According to the above configuration, because the Nmax and the Z are arbitrarily changeable parameters, the print operation suitable for any desired printing conditions can be performed. That is, the number of nozzles in the active nozzle row is associated with a band width, and the difference between the minimum and maximum values of the amount of shift is associated with an overlapping width of bands. Focusing on a printing speed, the Nmax is decreased and the Z is increased for a larger band width to reduce the band overlapping width. Then, higher printing speeds are attained. Focusing on a print quality, the Nmax is increased and the Z is decreased for a greater ratio of the overlapping band width to the band width. Then, higher degrees of print quality are attained.

$$N\max \geq 0.1 \times L/(P+1) \quad (1),$$

(where L is a total number of nozzles included in the nozzle row, and P is a print pass number).

The difference between the minimum and maximum values of the amount of shift is associated with the overlapping band width. Therefore, if the difference between the minimum and maximum values of the amount of shift has a small value, the banding may appear in the form of a band. This is more noticeable with a larger number of nozzles in total of the nozzle row and a smaller print pass number. Configuring the difference between the minimum and maximum values of the amount of shift+1 or Nmax as expressed in the formula (1), the banding is least likely to appear in the form of a band. As a result, higher-quality printed images can be obtained.

The inkjet printing device is preferably further characterized in that the nozzle selector selects the active nozzle row so that the difference between the minimum and maximum values of the amount of shift+1 equals Nmax (Nmax≥4), and a total amount of change in the amounts of shift when the active nozzle row is re-selected Nmax number of times is equal to or greater than $[(Nmax/2)^2+\{(Nmax/2)-1\}_2 (Nmax-1)]/2$.

The inkjet printing device is preferably further characterized in that the nozzle selector selects the active nozzle row so that the difference between the minimum and maximum values of the amount of shift +1 equals Nmax (Nmax•4), and a total amount of change in the amounts of shift when the active nozzle row is re-selected Nmax number of times is equal to or greater than $[(Nmax/2)^2+\{(Nmax/2)-1\}^2+(Nmax-1)]/2$.

By thus selecting the active nozzle row, changes of the end position(s) of the active nozzle row result in high frequency changes. This is because the amount of shift is associated with the end position(s) of the active nozzle row. A larger total amount of change in the amounts of shift, therefore, indicates a greater change of end position(s) of the active nozzle row in charge of printing at adjacent positions. In the event of low frequency changes of the end position(s) of the active nozzle row, for example, if the position of the active nozzle row is shifted by one nozzle at a time, a pattern formed by the end(s) of the active nozzle row is continuous, which is more noticeable to the eye. On the other hand, the inkjet printing device according to the above configuration can cause high frequency changes of the end position(s) of the active nozzle row, making a pattern formed by the end(s) of the active nozzle row least likely to be visually recognized. As a result, higher-quality printed images can be obtained.

The invention further provides a printing method using an inkjet printing device including a print head having a nozzle row with a plurality of aligned nozzles, the printing method including: a nozzle selecting step of selecting plural ones of the nozzles continuously aligned in a part of the nozzle row as an active nozzle row; a printing step of driving the print head to perform a scan in a main scan direction intersecting the nozzle row, the printing step further performing a print operation by discharging ink on a printing medium through the active nozzle row and at least one of the nozzles not continuous from at least one end of the active nozzle row; a nozzle re-selecting step of changing an amount of shift of the active nozzle row from one end of the nozzle row every time when the active nozzle row discharges ink a predetermined number of times; and a sub scan step of moving the printing medium relative to the print head in a sub scan direction in parallel with a direction in which the nozzle row is extending.

This printing method provides the same technical advantages as those provided by the inkjet printing device according to the invention.

The operation of the inkjet printing device according to different aspects of the invention may be carried out by using a computer. In the case of running the computer so as to function as the respective units of the inkjet printing device, the scope of this invention further includes a control program for the computer-controlled inkjet printing device, and a computer-readable recording medium on which the program is recorded.

Effects of the Invention

This invention effectively reduces banding that may appear on a print using a print head having a nozzle row to make vertical lines least noticeable, thereby improving the image quality of obtained printed images.

BRIEF DESCRIPTION OF THE DRAWINGS

FIGS. 9A and 9B are drawings of an example to describe an algorithm for selecting an active nozzle row according to the embodiment, wherein FIG. 9A is a pie graph representing the active nozzle row illustrated in FIG. 9B.

EMBODIMENT OF THE INVENTION

Figure 1:
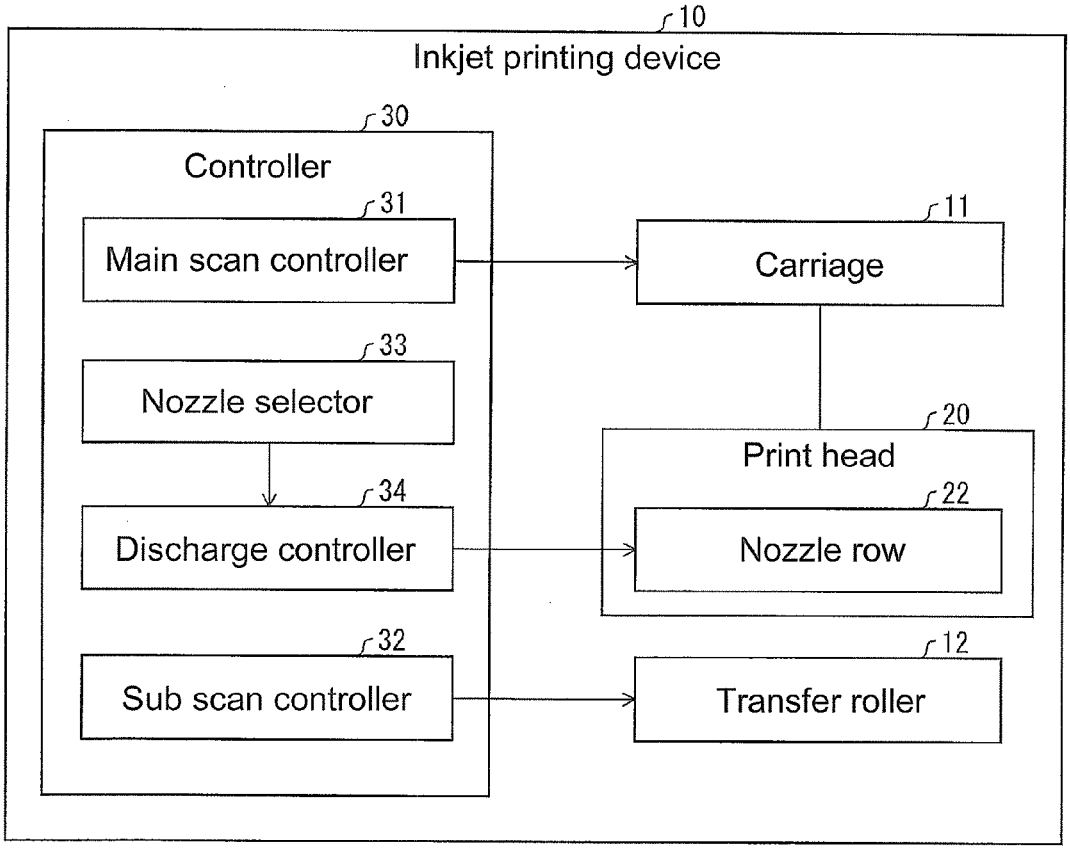
FIG. 1 is a functional block diagram schematically illustrating an inkjet printing device according to an embodiment of the invention.

FIG. 1 is a functional block diagram schematically illustrating an inkjet printing device 10 according to an embodiment of the invention. As illustrated in FIG. 1, the inkjet printing device 10 includes a carriage 11, a transfer roller 12, a print head 20, and a controller 30. The controller 30 includes a main scan controller 31, a sub scan controller 32, a nozzle selector 33, and a discharge controller 34.

The carriage 11 is a movable device mounted with the print head 20. The main scan controller 31, by controlling the carriage 11, drives the print head 20 to perform scans in a main scan direction.

Figure 2:
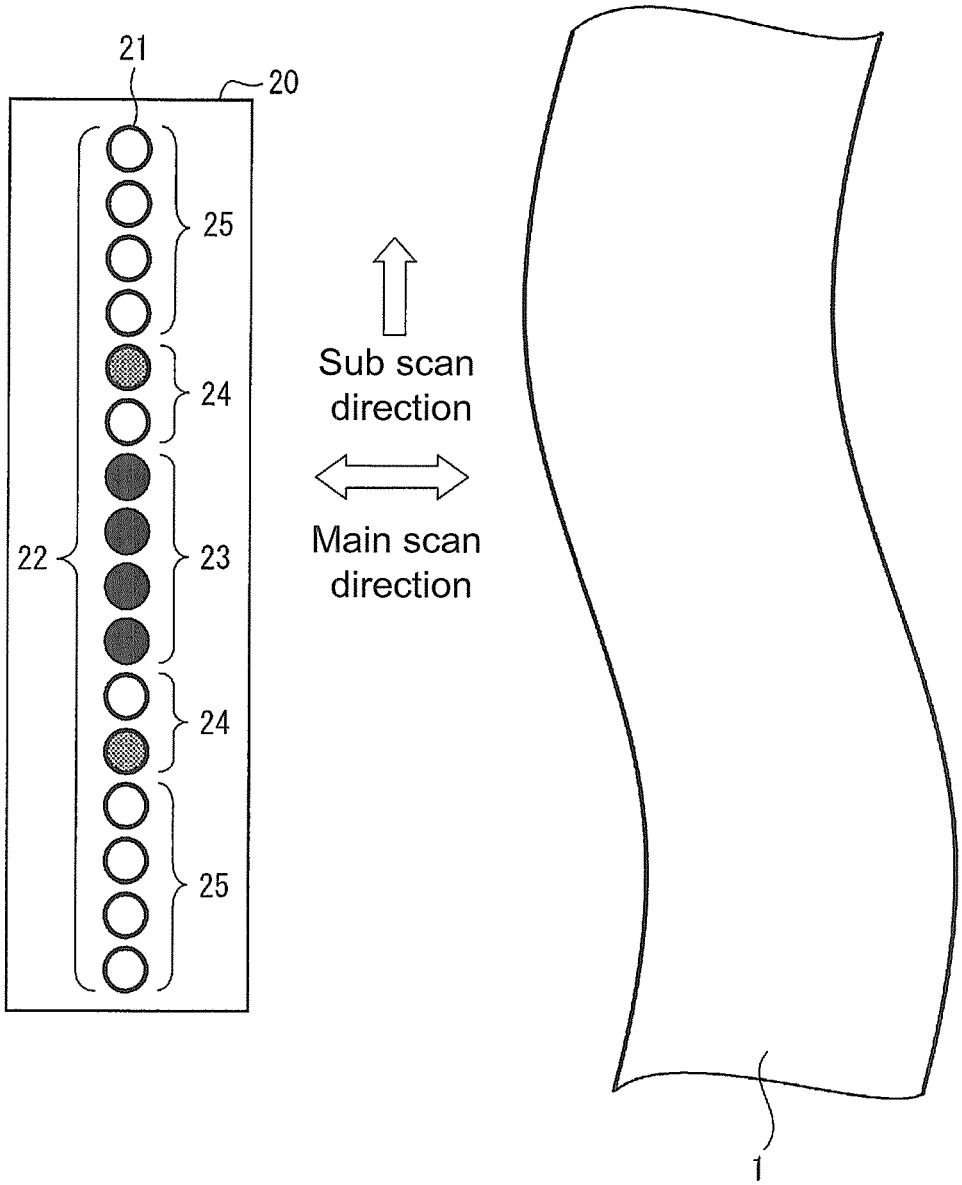
FIG. 2 is a drawing schematically illustrating a print head.

The transfer roller 12 is configured to transfer a printing medium 1 which is a print target (see FIG. 2). The sub scan controller 32 controls the transfer roller 12 to move the printing medium 1 relative to the print head 20 in a sub scan direction orthogonal to the main scan direction.

FIG. 2 is a drawing schematically illustrating the print head 20. As illustrated in FIG. 2, the print head 20 has a nozzle row 22 with a plurality of aligned nozzles 21. The nozzle row 22 is extending in a direction orthogonal to the main scan direction and parallel to the sub scan direction. The nozzles 21 are configured to discharge ink droplets. The nozzle row 22 of the print head 20 is not limited to one row but may be a plurality of nozzle rows.

The main scan controller 31 drives the print head 20 to perform scans in the main scan direction, and the discharge controller 34 drives a part of the nozzles 21 of the print head 20 to discharge ink on the printing medium 1 to print an image.

In FIG. 2, ink-discharge nozzles among all the nozzles are drawn in black and gray, and ink-discharge-inactive nozzles are drawn in white. The ink-discharge nozzles respectively discharge the ink droplets required for parts of an image to be printed at different target positions on the printing medium 1. None of the ink-discharge-inactive nozzles discharges ink.

As illustrated in FIG. 2, the ink-discharge nozzles include an active nozzle row 23 having a plurality of nozzles 21

(black) continuously aligned in a part of the nozzle row 22, and at least one of the nozzles 21 (gray) not continuous from at least one end of the active nozzle row 23. The nozzles 21 of the nozzle row 22 include the active nozzle row 23, a dot-lined part 24 not continuous from at least one end of the active nozzle row 23, and an ink-discharge-inactive part 25 consisting of ink-discharge-inactive nozzles.

The active nozzle row 23 includes the nozzles 21 selected by the nozzle selector 33. The nozzle selector 33 selects plural ones of the nozzles 21 continuously aligned in a part of the nozzle row 22 as the active nozzle row 23.

The active nozzle row 23 selected by the nozzle selector 33 and at least one of the nozzles 21 not continuous from at least one end of the active nozzle row 23 (gray nozzles 21 in FIG. 2) are driven by the discharge controller 34 to discharge ink.

The nozzle selector 33 re-selects the active nozzle row 23 so that an amount of shift of the active nozzle row 23 from one end of the nozzle row 22 is changed every time, when the active nozzle row 23 discharges ink a predetermined number of times. The "amount of shift of the active nozzle row 23 from one end of the nozzle row 22" described herein is represented by a value of the number of nozzles expressing how far one end of the active nozzle row 23 is shifted from one end of the nozzle row 22 on the same side.

Referring to the example illustrated in FIG. 2, the amount of shift is 6.

Figure 3B:
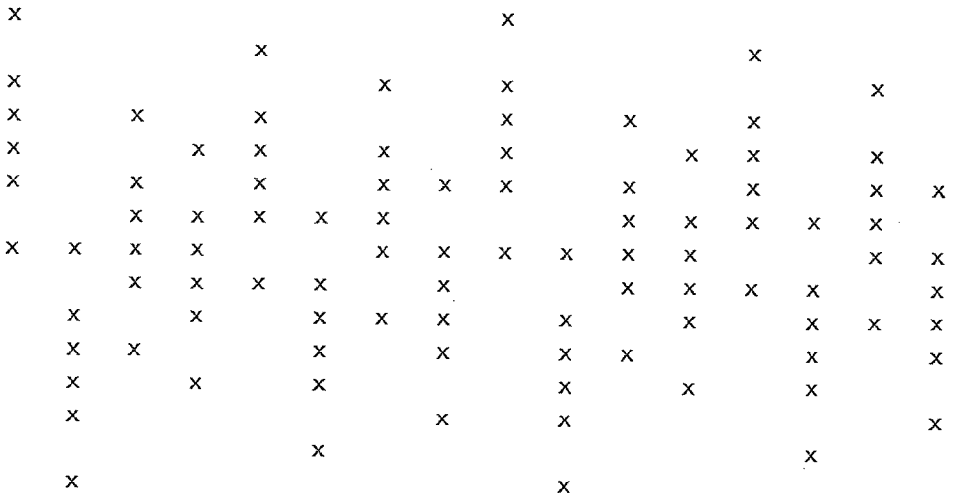
FIG. 3B is a drawing of an example of a region printed by scanning a line.
Figure 3A:
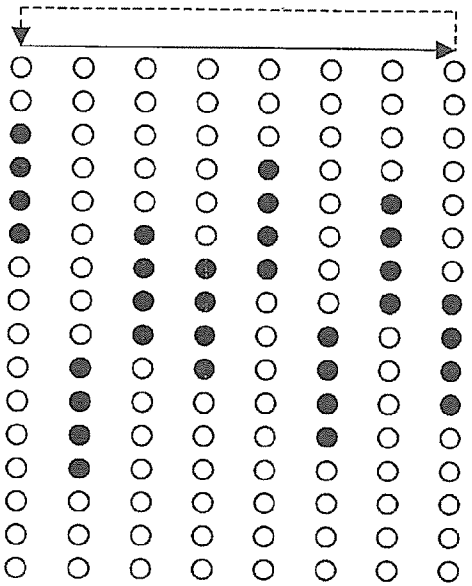
FIG. 3A is a drawing of an example of selecting an active nozzle row.

FIG. 3A is a drawing of an example of the active nozzle row 23 selected by the nozzle selector 33. As illustrated in FIG. 3A, for example, the nozzle selector 33 changes the amount of shift in a cycle of eight patterns. FIG. 3B is a drawing of an example of a region printed on the printing medium 1 by scanning a line when the active nozzle row 23 is re-selected (when the position of the active nozzle row 23 is changed) on the pattern illustrated in FIG. 3A for each ink discharge from the active nozzle row 23. As illustrated in FIG. 3B, the print operation is carried out with ends of the active nozzle row 23 being shifted. The ink is discharged at positions not continuous from ends of the active nozzle row 23. In FIG. 3B, the main scan direction is a horizontal direction on the drawing, and the sub scan direction is a vertical direction on the drawing.

When the scan of the same line by the main scan controller 31 is completed, the sub scan controller 32 moves the printing medium 1 relative to the print head 20 in the sub scan direction. Then, the print operation for plural bands is performed on the printing medium 1 as illustrated in FIG. 4A. As illustrated in FIG. 4A, on left side of FIG. 4A, a printable region by scanning first to third lines is shown. The plural bands printed by scanning first to third lines are illustrated on the right side on the drawing (numbers illustrated in the drawing indicate what number of the lines is scanned at the respective print positions). As illustrated in FIG. 4A, inter-band boundaries are shifted forward and backward in the sub scan direction. According to this embodiment, the nozzle selector 33 changes the amount of shift (position) of the ink-discharge active nozzle row 23 for a printing operation to be carried out, and inter-band boundaries can be accordingly shifted forward and backward in the sub scan direction. This can reduce the appearance of banding.

Figure 4B:
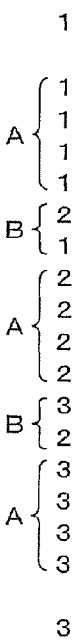
FIG. 4B is a drawing of an extracted part of the region.
Figure 4A:
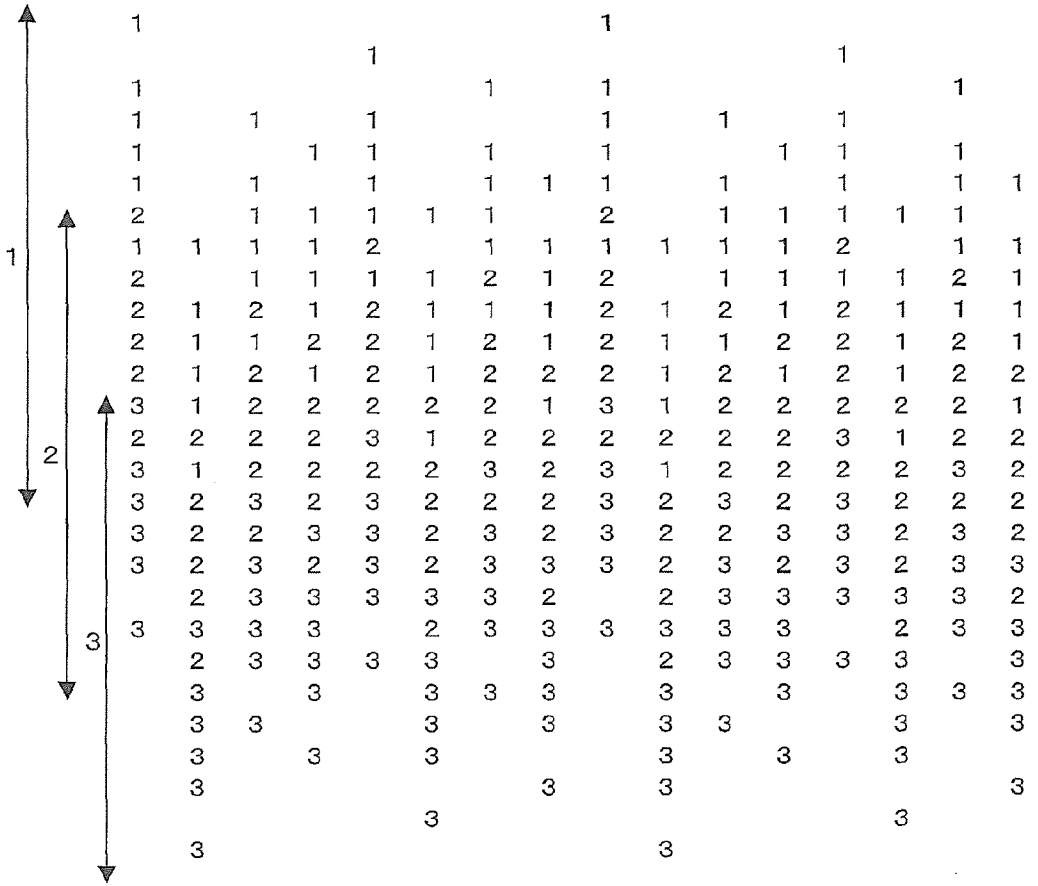
FIG. 4A is a drawing of an example of a region printed by scanning a plurality of lines.

FIG. 4B is a drawing of a vertical line extracted from the region illustrated in FIG. 4A. As illustrated in FIG. 4B, on a vertical line, between a region A printed with ink discharged through the active nozzle row 23 with the continuous nozzles 21 and a region A of a different band, there is an intermediate region B printed with ink discharged through the non-continuous nozzle. Providing such an intermediate region makes the vertical line least noticeable. According to the embodiment, ink is discharged through, in addition to the active nozzle row 23, the nozzle(s) 21 not continuous from at least one end of the active nozzle row 23. Then, the region printed with ink discharged through the non-continuous nozzle 21 is complemented with the bands adjacent thereto, and the intermediate region B can be accordingly provided. The vertical line with the intermediate region B interposed between the bands becomes least noticeable, providing printed images with a better image quality.

Figure 5A:
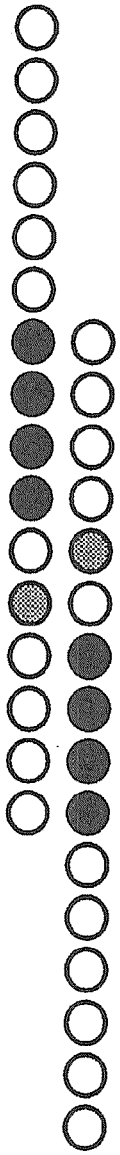
FIGS. 5A to 5C are drawings of exemplified nozzle positions at which ink is discharged.

At least one of the nozzles 21 not continuous from at least one end of the active nozzle row 23 is not necessarily the nozzles not continuous from ends of the active nozzle row 23 on both sides as illustrated in FIG. 2, but may be the nozzle 21 not continuous from one end of the active nozzle row 23 as illustrated in FIG. 5A. In that case, as illustrated in FIG. 5A, one end of the active nozzle row 23 not continuous to the nozzle 21 may be alternately changed for each line scan, so that the intermediate region B is complemented from both sides.

Figure 5B:
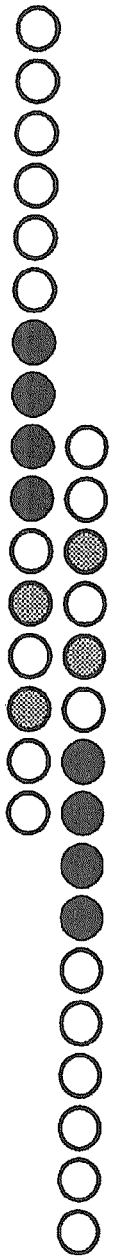

At least one of the nozzles 21 not continuous from at least one end of the active nozzle row 23 is not necessarily one non-continuous nozzle 21 as illustrated in FIG. 2, but may be two or more nozzles 21 not continuous from at least one end of the active nozzle row 23 as illustrated in FIG. 5B. FIG. 5B illustrates the nozzles 21 in which the intermediate region B is complemented from both sides.

Figure 5C:
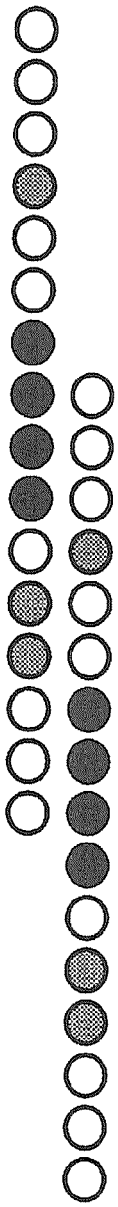

At least one of the nozzles 21 not continuous from at least one end of the active nozzle row 23 is not necessarily the nozzle(s) next but one to at least one end of the active nozzle row 23 as illustrated in FIG. 2, but may be the nozzle(s) 21 next but two to at least one end of the active nozzle row 23 or two or more consecutive nozzles 21 unless they are continuous from at least one end of the active nozzle row 23 as illustrated in FIG. 5C. FIG. 5C illustrates the nozzles 21 in which the intermediate region B is complemented from both sides.

Multi-Pass Printing

Figure 6B:
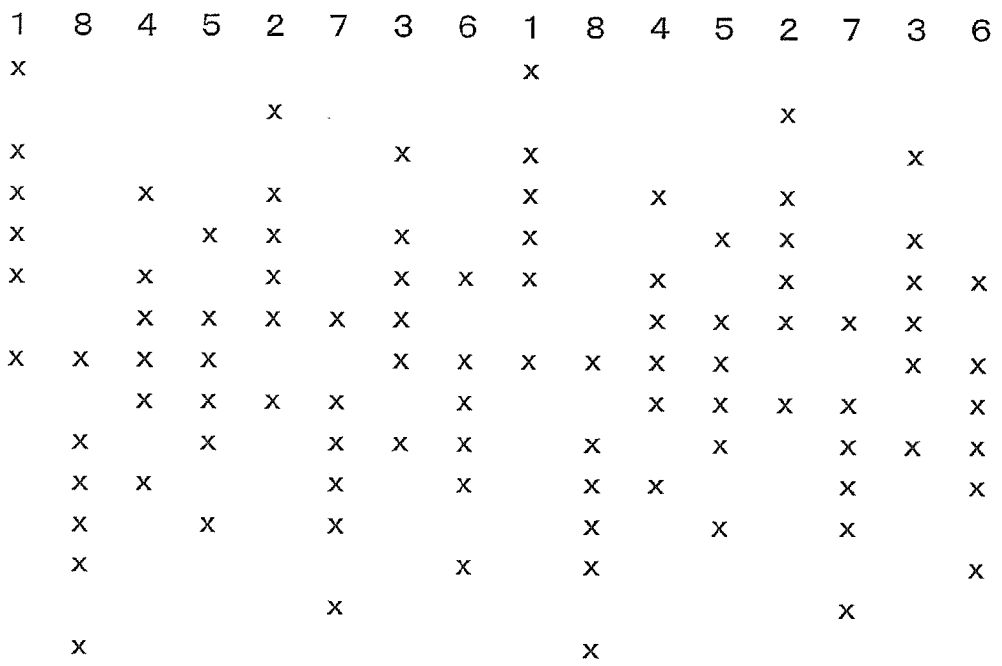
FIG. 6B is a drawing of an example of a region printed in each scan.
Figure 6A:
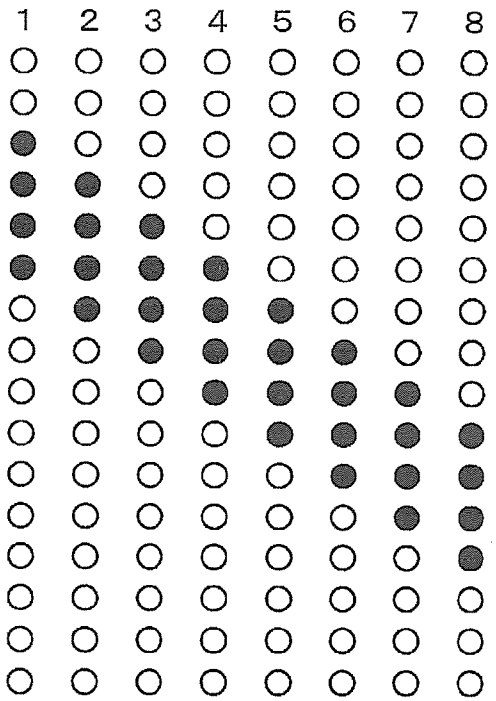
FIG. 6A is a drawing of an example of selecting an active nozzle row in each scan by multi-pass printing.

The number of passes is not limited as far as the print operation can be carried out as illustrated in FIGS. 4A and 4B. In the case of multi-pass printing, the print operation may be carried out as illustrated in FIGS. 6A and 6B. FIGS. 6A and 6B illustrate eight scans for the same line.

As illustrated in FIG. 6A, the nozzle selector 33 selects the active nozzle row 23 by shifting to a next nozzle at a time. Each of the numbers illustrated at the top of the drawing indicates the ordinal number of the scan performed for the active nozzle row 23. By selecting the print position in each scan as illustrated in FIG. 6B, the print operation can be carried out in the same manner as illustrated in FIGS. 4A and 4B. Each of the numbers illustrated at the top of FIG. 6B indicates the ordinal number of the scan performed for the printing region. The nozzle selector 33 re-selects the active nozzle row 23 every time when the active nozzle row 23 discharges ink the number of times for each scan.

Amount of Shift

According to this embodiment, an amount of shift in each scan is not particularly limited as far as the nozzle selector 33 can change the position of the active nozzle row 23. The nozzle selector 33, however, can obtain a more desirable result by changing the position of the active nozzle row 23 under the following condition.

In the examples illustrated in FIGS. 2, 3A and 3B, 4A and 4B, 5A to 5C, and 6A and 6B, the nozzle selector 33 selects the active nozzle row 23 under the condition that 4 is the number of nozzles in the active nozzle row 23, and 7 is a difference between a maximum value (9: 2nd one from the left in FIG. 3A) and a minimum value (2: 1st one from the left in FIG. 3A) of an amount of shift of the active nozzle row 23 from one end of the nozzle row 22.

Figure 7B:
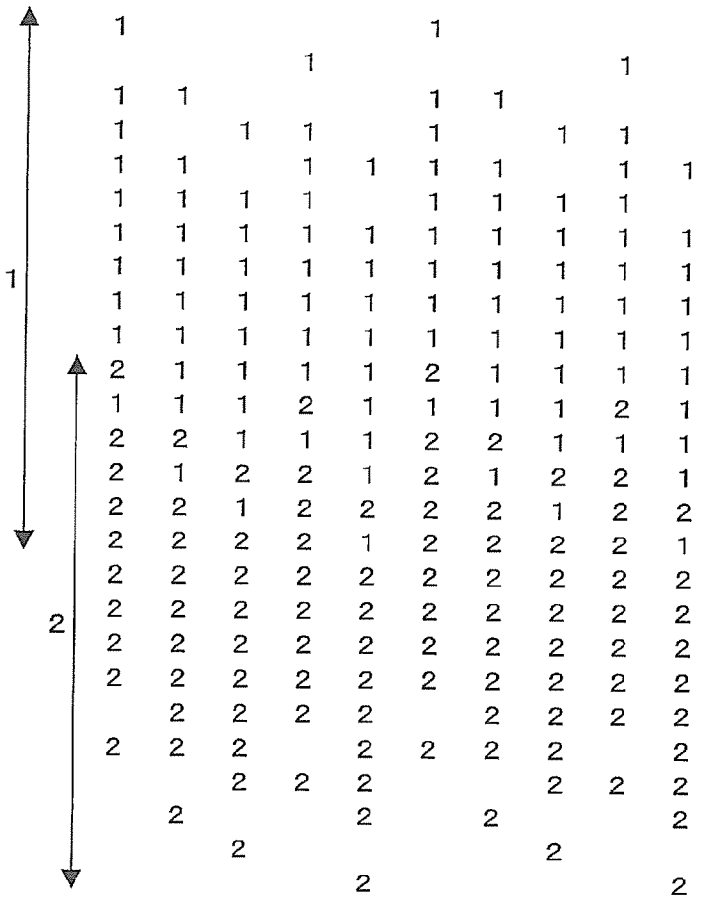
FIG. 7B is a drawing of an example of a region printed on a printing medium when the active nozzle row is re-selected on the pattern illustrated in FIG. 7A.
Figure 7A:
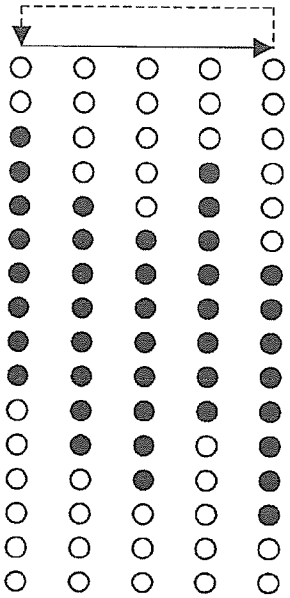
FIG. 7A is a drawing of another example of selecting an active nozzle row.

As compared to these examples, a higher printing speed can be attained by increasing the number of nozzles in the active nozzle row 23 (8) and decreasing the difference between the maximum and minimum values of the amount of shift (4) as illustrated in FIGS. 7A and 7B. The number of nozzles in the active nozzle row 23 is associated with a band width, and the difference between the minimum and maximum values of the amount of shift is associated with an overlapping width of bands. Therefore, higher printing speeds are attained by increasing the number of nozzles in the active nozzle row 23 and decreasing the difference between the minimum and maximum values of the amount of shift for a larger band width to reduce the band overlapping width.

FIG. 7A is a drawing of another example of selecting the active nozzle row 23. FIG. 7B is a drawing of a region printed on the printing medium 1 when the active nozzle row 23 is re-selected (position of the active nozzle row 23 is changed) on the pattern illustrated in FIG. 7A.

Figure 8B:
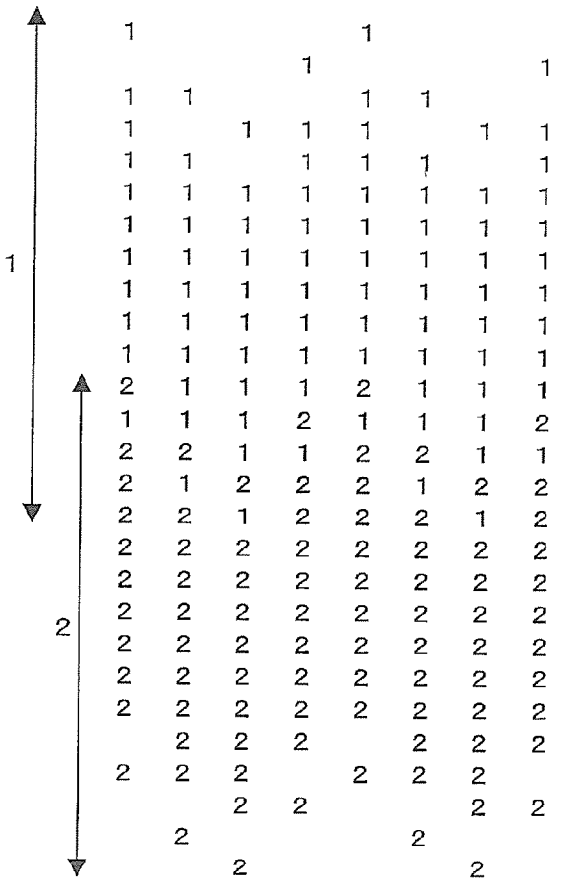
FIG. 8B is a drawing of an example of a region printed on a printing medium when the active nozzle row is re-selected on the pattern illustrated in FIG. 8A.
Figure 8A:
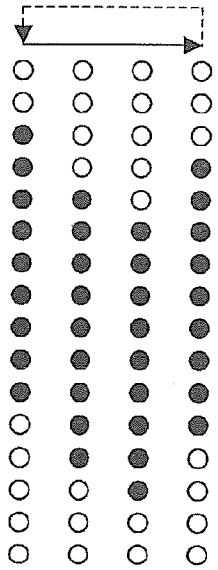
FIG. 8A is a drawing of yet another example of selecting an active nozzle row.

As illustrated in FIGS. 8A and 8B, an even higher printing speed can be attained by further increasing the number of nozzles in the active nozzle row 23 (9) and decreasing the difference between the maximum and minimum values of the amount of shift (3). FIG. 8A is a drawing of yet another example of selecting the active nozzle row 23. FIG. 8B is a drawing of an example of a region printed on the printing medium 1 when the active nozzle row 23 is re-selected (position of the active nozzle row 23 is changed) on the pattern illustrated in FIG. 8A.

On the other hand, as illustrated in FIGS. 2, 3A and 3B, 4A and 4B, 5A to 5C, and 6A and 6B, higher degrees of print quality can be attained by decreasing the number of nozzles in the active nozzle row 23 and increasing the difference between the maximum and minimum values of the amount of shift to increase a ratio of the band overlapping width to the band width.

As described, a print operation that meets any desired condition can be carried out by suitably changing the number of nozzles in the active nozzle row 23 and the difference between the maximum and minimum values of the amount of shift of the active nozzle row 23 from one end of the nozzle row 22. The print operation can be successfully carried out under any printing condition according to users' demands if the inkjet printing device 10 (controller 30) has parameters Nmax and Z, and the nozzle selector 33 selects the active nozzle row 23 so that number of nozzles in the active nozzle row 23 is Z, and the difference between the minimum and maximum values of the amount of shift +1 equals Nmax.

Configuring the Nmax and the Z as arbitrarily changeable parameters allows users to print images under any printing condition according to their demands. The values of Nmax and Z may be changed in each print operation or during the print operation. According to the embodiment, values of Nmax and Z may be automatically set by the controller 30, or values of Nmax and Z may be preset fixed values.

Preferably, the Nmax satisfies the following formula (1).

$$N\max \geq 0.1 \times L/(P+1) \quad (1),$$

(where L is a total number of nozzles included in the nozzle row, and P is a print pass number).

The difference between the minimum and maximum values of the amount of shift is associated with the band overlapping width. Therefore, if the difference between the minimum and maximum shift value has a small value, the banding may appear in the form of a band. This is more noticeable with a larger total number of nozzles in the nozzle row and a smaller print pass number. Configuring the difference between the minimum and maximum values of the amount of shift+1 or Nmax as expressed in the formula (1), the banding is least likely to appear in the form of a band.

In this description, the print pass number P indicates "number of scans required to complete the print of an image on a region".

For example, in the case of 3-pass print using a print head 20 having a nozzle row 22 with 320 aligned nozzles 21, the Nmax is preferably equal to or greater than 8.

The upper-limit value of Nmax, though not particularly limited, is preferably equal to or less than $0.9 \times L/(P+1)$.

The nozzle selector 33 preferably selects the active nozzle row 23 so that a total amount of change in the amounts of shift when the active nozzle row 23 is re-selected Nmax number of times is equal to or greater than $[(Nmax/2)^2+\{(Nmax/2)-1\}^2+(Nmax-1)]/2$ (where $Nmax \geq 4$).

More specifically, when selecting the active nozzle row 23 as illustrated in FIG. 3A, the Nmax is 8, and $[(Nmax/2)^2+\{(Nmax/2)-1\}^2+(Nmax-1)]/2$ equals 16. The amount of change in the amounts of shift in each of Nmax number of re-selections is 7, 4, 1, 3, 5, 4, 3, and 5, which are 32 in total.

By thus selecting the active nozzle row 23, changes of the end position(s) of the active nozzle row 23 result in high frequency changes. This is because the amount of shift is associated with the end position(s) of the active nozzle row 23, and there is a greater change in the end position(s) of the active nozzle row 23 in charge of printing at adjacent positions with a larger total amount of change in the amounts of shift. Such high frequency changes of the end position(s) of the active nozzle row 23 can make a pattern formed by the end(s) of the active nozzle row 23 least likely to be visually recognized.

The selection of the active nozzle row 23 described so far is implemented based on, for example, an algorithm described below.

Figure 9B:
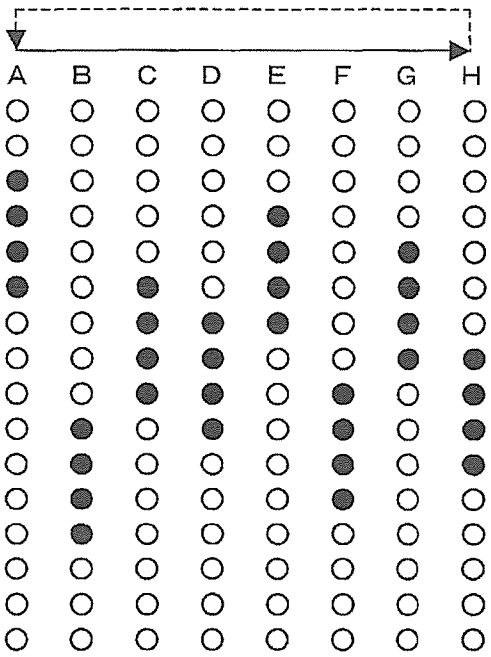
Figure 9A:
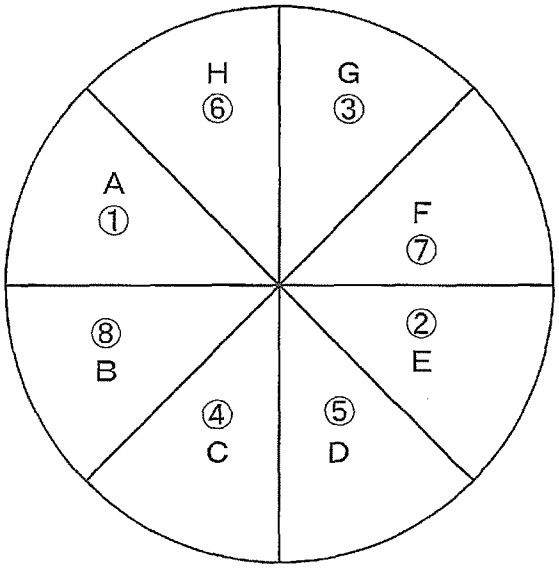
Figure 10A:
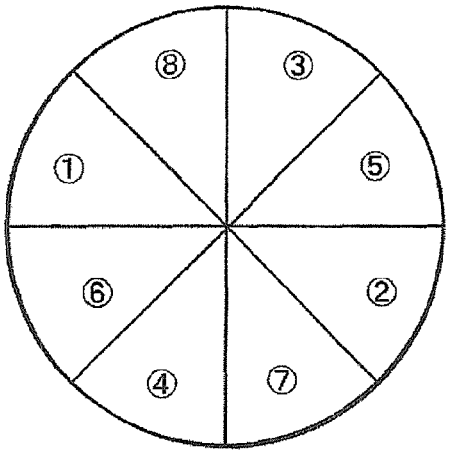
FIGS. 10A to 10E are drawings of examples to describe an algorithm for selecting an active nozzle row according to the embodiment.
Figure 10D:
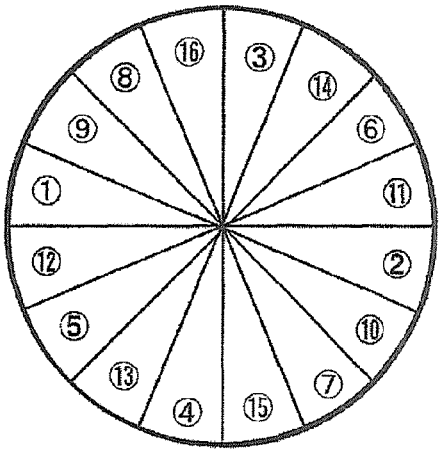
Figure 10B:
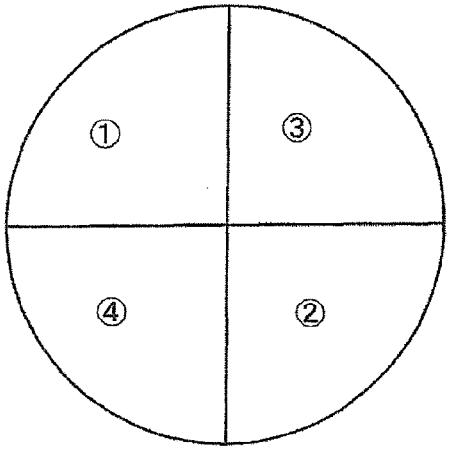
Figure 10E:
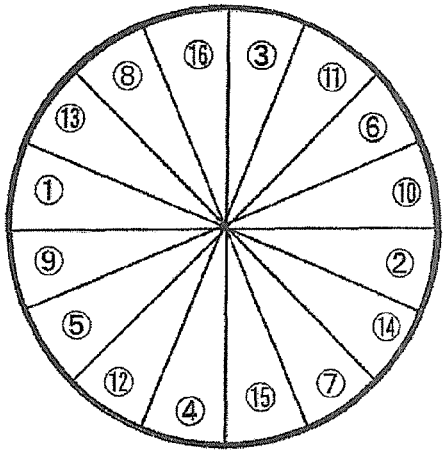
Figure 10C:
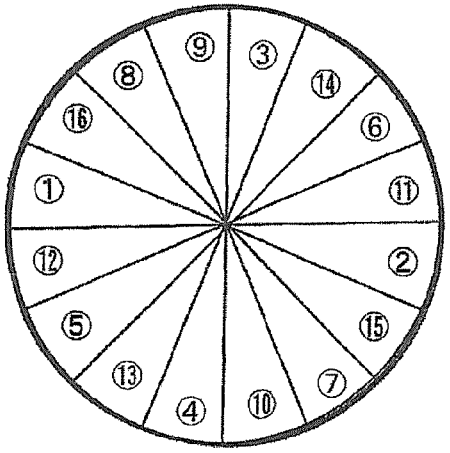

FIGS. 9A and 9B are drawings of an example for describing the algorithm. The alphabets A to H of the pie graph illustrated in FIG. 9A indicate A to H each representing the active nozzle row 23 illustrated in FIG. 9B. Each of the numbers 1 to 8 illustrated in FIG. 9A indicates the ordinal number of the active nozzle row 23 illustrated in FIG. 9B in the ascending order of an amount of shift. In the example illustrated in FIGS. 9A and 9B, the amount of shift is "−3".

Referring to FIG. 9A, first, (i) 1 is assigned to A. Then, (ii) an even ordinal number (2nd, 4th, 6th, 8th) is assigned to a diagonally opposite block with a lower number (for example, 2 is assigned to E diagonally opposite to A with 1); and (iii) an odd ordinal number (3rd, 5th, 7th) is assigned to, (iii-A) of optionally divided semi-circles (for example, semi-circle consisting of A to C and H, and semi-circle consisting of D to G), a block most distant from a block with a lower number in the semi-circle including the lower number (for example, 3 is assigned to G most distant from a block with 2 in the semi-circle consisting of D to G including 2). By repeating these steps, the pattern illustrated in FIG. 9A is obtained. The nozzle selector 33 selects the active nozzle row 23 in the order of 1, 8, 4, 5, 2, 7, 3, 6. Then, the end position(s) of the active nozzle row 23 in charge of printing at adjacent positions are maximally changed. Such high frequency changes of the end position(s) of the active nozzle row 23 can make a pattern formed by the end(s) of the active nozzle row 23 least likely to be visually recognized. In the example illustrated in FIG. 9A, a total amount of change in the amounts of shift when the active nozzle row 23 is re-selected Nmax number of times is 32, and $[(Nmax/2)^2+\{(Nmax/2)-1\}^2+(Nmax-1)]/2$ is equal to or greater than 16.

It is to be noted that (iii-A) is not an essential requirement as far as the respective numbers in total of left and right semi-circles are equal (numbers of A to C and H in total=numbers of D to G in total), the respective numbers in total of upper and lower semi-circles are equal (numbers of A and F to H in total=numbers of B to E in total), or summed numbers of adjacent odd and even numbers are equal. Alternatively, the respective numbers in total of quartered blocks of the circle are all equal (A+H=B+C=E+F=G+H), or the respective numbers in total of diagonally opposite ones of the quartered blocks are equal (A+H=D+E).

FIGS. 10A to 10E illustrate patterns of the active nozzle row 23 selected by an algorithm similar to the algorithm illustrated in FIGS. 9A and 9B. In the example illustrated in FIG. 10B, the respective numbers in total of left and right semi-circles are equally 5. In the examples illustrated in FIGS. 10C and 10D, the respective numbers in total of left and right semi-circles are equally 68, and the respective numbers in total of quartered blocks are equally 34. In the example illustrated in FIG. 10E, the respective numbers in total of left and right semi-circles are equally 68. In each of these patterns, similarly to the pattern illustrated in FIGS. 9A and 9B, the total amount of change in the amounts of shift when the active nozzle row 23 is re-selected Nmax number of times is equal to or greater than $[(Nmax/2)^2+\{(Nmax/2)-1\}^2+(Nmax-1)]/2$ (where Nmax≥4), resulting in high frequency changes of the end(s) of the active nozzle row 23.

Examples Using Software

The control blocks of the inkjet printing device 10 (particularly, main scan controller 31, sub scan controller 32, nozzle selector 33, and discharge controller 34) may be operated by a logic circuit (hardware) configured in, for example, an integrated circuit (IC chip) or operated by software installed in CPU (Central Processing Unit).

In the latter case, the inkjet printing device 10 includes CPU configured to execute commands of a program installed for the respective functions, ROM (Read-Only Memory) or a storage unit in which the program and data are recorded in a computer (or CPU)-readable manner (collectively called "recording medium"), and RAM (Random Access Memory) for running the program. The computer (or CPU) reads the program from the recording medium and executes the read program to accomplish the object of the invention. The recording medium may be a "non-temporary and tangible medium", examples of which are tapes, discs, cards, semiconductor memories, and programmable logic circuits. The program may be installed in the computer via an optional transmission medium configured to transmit the program (communication network or broadcast wave). The invention may be actualized by the program electronically transmitted in the form of signals embedded in carrier wave.

SUMMARY

According to the invention, the inkjet printing device 10 includes: a print head 20 having a nozzle row 22 with a plurality of aligned nozzles 21; a nozzle selector 33 for selecting plural ones of the nozzles 21 continuously aligned in a part of the nozzle row 22 as an active nozzle row 23; a main scan controller 31 for driving the print head 20 to perform a scan in a main scan direction intersecting the nozzle row 22; and a sub scan controller 32 for moving a printing medium 1 relative to the print head 20 in a sub scan direction in parallel with a direction in which the nozzle row 22 is extending, wherein a print operation includes: having the print head 20 be driven by the main scan controller 31 to perform the scan in the main scan direction; and discharging ink on the printing medium 1 through the active nozzle row 23 and at least one of the nozzles 21 not continuous from at least one end of the active nozzle row 23, and the nozzle selector 33 re-selects the active nozzle row 23 so that an amount of shift of the active nozzle row 23 from one end of the nozzle row 22 is changed every time when the active nozzle row 23 discharges ink a predetermined number of times.

According to the above configuration, when a print operation is carried out, the nozzle selector 33 changes the amount of shift (position) of the ink-discharge active nozzle row 23 and thereby shifts the inter-band boundaries forward and backward in the sub scan direction, reducing the appearance of banding.

In the case of discharging ink from the active nozzle row 23 alone, which have plural ones of the nozzles 21 continuously aligned in a part of the nozzle row 22, vertical lines may stand out in an obtained printed image. In contrast, this invention is characterized in that ink is discharged through, in addition to the active nozzle row 23, the nozzle(s) 21 not continuous from at least one end of the active nozzle row 23. On a vertical line of a printed image, between parts of the image printed with ink discharged through the continuously aligned nozzles 21 (active nozzle row 23), there is accordingly an intermediate region printed with ink discharged through the nozzle(s) 21 not continuous therefrom. This makes the vertical line least noticeable. As a result, higher-quality printed images can be obtained.

The inkjet printing device 10 is preferably further characterized in that the nozzle selector 33 selects the active nozzle row 23 so that the number of nozzles in the active nozzle row 23 is Z, and the difference between the minimum and maximum values of the amount of shift +1 equals Nmax, wherein the Nmax and the Z are parameters that are arbitrarily changeable.

According to the above configuration, because the Nmax and the Z are arbitrarily changeable parameters, the print operation suitable for any desired printing conditions can be performed. That is, the number of nozzles in the active nozzle row 23 is associated with a band width, and the difference between the minimum and maximum values of the amount of shift is associated with an overlapping width of bands. To desirably print an image at a high speed, the Nmax is decreased and the Z is increased to increase the band width and thereby reduce the band overlapping width. Then, higher printing speeds are attained. To desirably print an image with a high quality, the Nmax is increased and the Z is decreased to increase a ratio of the band overlapping width to the band width. Then, the printing quality of an image is improved.

The inkjet printing device 10 is preferably further characterized in that the nozzle selector 33 selects the active nozzle row 23 so that the difference between the minimum and maximum values of the amount of shift +1 equals Nmax, wherein the Nmax satisfies the following formula (1);

$$Nmax \geq 0.1 \times L/(P+1) \quad (1)$$

(where L is a total number of nozzles included in the nozzle row 22, and P is a print pass number).

The difference between the minimum and maximum values of the amount of shift is associated with the band overlapping width. Therefore, if the difference between the minimum and maximum values of the amount of shift has a small value, the banding may appear in the form of a band. This is more noticeable with a larger total number of nozzles in the nozzle row and a smaller print pass number. Configuring the difference between the minimum and maximum values of the amount of shift+1 or Nmax as expressed in the formula (1), the banding is least likely to appear in the form of a band. As a result, higher-quality printed images can be obtained.

The inkjet printing device 10 is preferably further characterized in that the nozzle selector 33 selects the active nozzle row 23 so that the difference between the minimum and maximum values of the amount of shift+1 equals Nmax (Nmax≥4), and the total amount of change in the amounts of shift when the active nozzle row 23 is re-selected Nmax number of times is equal to or greater than $[(Nmax/2)^2+\{(Nmax/2)-1\}^2(Nmax-1)]/2$.

By thus selecting the active nozzle row 23, changes of the end position(s) of the active nozzle row 23 result in high frequency changes. This is because the amount of shift is associated with the end position(s) of the active nozzle row 23, and there is a greater change in the end position(s) of the active nozzle row 23 in charge of printing at adjacent positions with a larger total amount of change in the amounts of shift. In the event of low frequency changes of the end position(s) of the active nozzle row 23, for example, if the position of the active nozzle row 23 is shifted by one nozzle at a time, a pattern formed by the end(s) of the active nozzle row 23 is continuous, which is more noticeable to the eye. On the other hand, the inkjet printing device according to the above configuration can cause high frequency changes of the end position(s) of the active nozzle row 23, making a pattern formed by the end(s) of the active nozzle row 23 least likely to be visually recognized. As a result, higher-quality printed images can be obtained.

The printing method according to the embodiment is a printing method using the inkjet printing device 10 including the print head 20 having the nozzle row 22 with the aligned nozzles 21. The method includes: a nozzle selecting step for selecting plural ones of the nozzles 21 continuously aligned in a part of the nozzle row 22 as an active nozzle row 23; a print step for driving the print head 20 to perform a scan in a main scan direction intersecting the nozzle row 22, the print step further performing a print operation by discharging ink on a printing medium 1 through the active nozzle row 23 and at least one of the nozzles 21 not continuous from at least one end of the active nozzle row 23; a nozzle re-selecting step for changing an amount of shift of the active nozzle row 23 from one end of the nozzle row 22 every time when the active nozzle row 23 discharges ink a predetermined number of times; and a sub scan step for moving the printing medium 1 relative to the print head 20 in a sub scan direction in parallel with a direction in which the nozzle row 22 is extending.

This method provides the same technical advantages as those provided by the inkjet printing device 10 according to the embodiment.

The invention is not necessarily limited to the embodiments described so far and may be carried out in many other forms. The technical scope of the invention encompasses any modifications within the scope of the invention defined by the appended claims and embodiments obtained by variously combining the technical means disclosed herein.

INDUSTRIAL APPLICABILITY

The invention is applicable to the field relating to production of inkjet printing devices.

The invention claimed is:

1. An inkjet printing device, comprising:

a print head having a nozzle row with a plurality of aligned nozzles;

a nozzle selector for selecting plural ones of the nozzles continuously aligned in a part of the nozzle row as an active nozzle row;

a main scan controller for driving the print head to perform a scan in a main scan direction intersecting the nozzle row; and a sub scan controller for moving a printing medium relative to the print head in a sub scan direction in parallel with a direction in which the nozzle row is extending, wherein the print head is driven by the main scan controller to perform the scan in the main scan direction and discharge ink on the printing medium through the active nozzle row and at least one of the nozzles not continuous from at least one end of the active nozzle row for performing a print operation, and the nozzle selector re-selects the active nozzle row so that an amount of shift of the active nozzle row from one end of the nozzle row is changed every time, when the active nozzle row discharges ink a predetermined number of times, wherein the nozzle row includes: the active nozzle row, the nozzles not continuous from at least one end of the active nozzle row, and an ink-discharge-inactive part consisting of ink-discharge-inactive nozzles, the nozzles not continuous from at least one end of the active nozzle row is disposed between the active nozzle row and the ink-discharge-inactive part, a relative position relationship between an active nozzle region of the active nozzle row, a not continuous region of the nozzles not continuous from at least one end of the active nozzle row and an ink-discharge-inactive region of the ink-discharge-inactive part is fixed.

2. The inkjet printing device according to claim 1, wherein the nozzle selector selects the active nozzle row so that the difference between the minimum and maximum values of the amount of shift+1 equals Nmax, where Nmax≥4, and a total amount of change in the amounts of shift when the active nozzle row is re-selected Nmax number of times is equal to or greater than $[(Nmax/2)^2+\{(Nmax/2)-1\}^2+(Nmax-1)]/2$.

3. The inkjet printing device according to claim 1, wherein the nozzle selector selects the active nozzle row so that the active nozzle row has Z nozzles, and a difference between minimum and maximum values of the amount of shift+1 equals Nmax, wherein the Nmax and the Z are parameters that are arbitrarily changeable.

4. The inkjet printing device according to claim 3, wherein the nozzle selector selects the active nozzle row so that the difference between the minimum and maximum values of the amount of shift+1 equals Nmax, where Nmax≥4, and a total amount of change in the amounts of shift when the active nozzle row is re-selected Nmax number of times is equal to or greater than $[(Nmax/2)^2+\{(Nmax/2)-1\}^2+(Nmax-1)]/2$.

5. The inkjet printing device according to claim 1, wherein the nozzle selector selects the active nozzle row so that the difference between the minimum and maximum values of the amount of shift+1 equals Nmax, wherein the Nmax satisfies the following formula (1);

$$Nmax \geq 0.1 \times L/(P+1) \quad (1)$$

where L is a total number of nozzles included in the nozzle row, and P is a print pass number.

6. The inkjet printing device according to claim 5, wherein the nozzle selector selects the active nozzle row so that the difference between the minimum and maximum values of the amount of shift+1 equals Nmax, where Nmax≥4, and a total amount of change in the amounts of shift when the active nozzle row is re-selected Nmax number of times is equal to or greater than $[(Nmax/2)^2+\{(Nmax/2)-1\}^2+(Nmax-1)]/2$.

7. A printing method using an inkjet printing device comprising a print head having a nozzle row with a plurality of aligned nozzles, and the printing method comprising:

a nozzle selecting step of selecting plural ones of the nozzles continuously aligned in a part of the nozzle row as an active nozzle row;

a printing step of driving the print head to perform a scan in a main scan direction intersecting the nozzle row, the printing step further performing a print operation by discharging ink on a printing medium through the active nozzle row and at least one of the nozzles not continuous from at least one end of the active nozzle row;

a nozzle re-selecting step of changing an amount of shift of the active nozzle row from one end of the nozzle row every time when the active nozzle row discharges ink a predetermined number of times; and a sub scanning step of moving the printing medium relative to the print head in a sub scan direction in parallel with a direction in which the nozzle row is extending, wherein the nozzle row includes: the active nozzle row, the nozzles not continuous from at least one end of the active nozzle row, and an ink-discharge-inactive part consisting of ink-discharge-inactive nozzles, the nozzles not continuous from at least one end of the active nozzle row is disposed between the active nozzle row and the ink-discharge-inactive part, a relative position relationship between an active nozzle region of the active nozzle row, a not continuous region of the nozzles not continuous from at least one end of the active nozzle row and an ink-discharge-inactive region of the ink-discharge-inactive part is fixed.

8. The printing method according to claim 7, wherein the nozzle selecting step selects the active nozzle row so that the active nozzle row has Z nozzles, and a difference between minimum and maximum values of the amount of shift+1 equals Nmax, wherein the Nmax and the Z are parameters that are arbitrarily changeable.

9. The printing method according to claim 7, wherein the nozzle selecting step selects the active nozzle row so that the difference between the minimum and maximum values of the amount of shift+1 equals Nmax, wherein the Nmax satisfies the following formula (1);

$$Nmax \geq 0.1 \times L/(P+1) \quad (1)$$

where L is a total number of nozzles included in the nozzle row, and P is a print pass number.

10. The printing method according to claim 7, wherein the nozzle selecting step selects the active nozzle row so that the difference between the minimum and maximum values of the amount of shift+1 equals Nmax, where Nmax≥4, and a total amount of change in the amounts of shift when the active nozzle row is re-selected Nmax number of times is equal to or greater than $[(Nmax/2)^2+\{(Nmax/2)-1\}^2+(Nmax-1)]/2$.

* * * * *